US010712082B1

(12) United States Patent
Nuss

(10) Patent No.: US 10,712,082 B1
(45) Date of Patent: Jul. 14, 2020

(54) REFRIGERATOR APPLIANCE WITH AUTOMATIC OPEN DRAWER FRONT

(71) Applicant: Haier US Appliance Solutions, Inc., Wilmington, DE (US)

(72) Inventor: Bart Andrew Nuss, Fisherville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 16/504,625

(22) Filed: Jul. 8, 2019

(51) Int. Cl.

| | |
|---|---|
| ***F25D 25/02*** | (2006.01) |
| ***E05B 65/00*** | (2006.01) |
| ***E05C 19/10*** | (2006.01) |
| ***E05D 11/10*** | (2006.01) |
| ***E05B 65/46*** | (2017.01) |
| ***F25D 23/02*** | (2006.01) |

(52) U.S. Cl.
CPC ..... *F25D 25/025* (2013.01); *E05B 65/0042* (2013.01); *E05B 65/46* (2013.01); *E05C 19/10* (2013.01); *E05D 11/1007* (2013.01); *F25D 23/021* (2013.01); *E05Y 2900/31* (2013.01)

(58) Field of Classification Search
CPC ..... F25D 23/02; F25D 23/021; F25D 23/028; F25D 25/025; F25D 2323/02; F25D 2323/024; Y10T 16/54026; Y10T 16/5404; Y10T 16/54; Y10T 292/1047; Y10T 292/1051; Y10T 292/1052; Y10T 292/1043; Y10T 292/0926; Y10T 292/0928; Y10T 292/0934; Y10T 292/0911; E05D 11/1007; Y10S 292/71; A47B 88/0044; A47B 88/944; E05B 65/0042; E05B 65/46; E05C 19/10; E05Y 2900/31
See application file for complete search history.

(56) References Cited

U.S. PATENT DOCUMENTS

| | | | | |
|---|---|---|---|---|
| 3,033,637 | A | 5/1962 | Donk Van | |
| 7,731,314 | B2 | 6/2010 | Kim | |
| 8,459,759 | B2 * | 6/2013 | Kang | F25D 23/021 312/302 |
| 9,752,817 | B2 | 9/2017 | Richards et al. | |
| 2007/0035222 | A1 | 2/2007 | Lee et al. | |

FOREIGN PATENT DOCUMENTS

| | | | | |
|---|---|---|---|---|
| JP | 2017020718 A | * | 1/2017 | F25D 25/025 |
| JP | 2017101891 A | * | 6/2017 | |

* cited by examiner

*Primary Examiner* — Andrew M Roersma
(74) *Attorney, Agent, or Firm* — Dority & Manning, P.A.

(57) ABSTRACT

A refrigerator appliance includes a cabinet and a drawer slidably mounted within the cabinet. The drawer includes a drawer body and a door attached to the drawer body via a hinge such that the door is rotatable relative to the drawer body between a closed position and an open position. The drawer also includes a latch configured to retain the door in the closed position when the latch is locked. The drawer is slidable between a retracted position where the door of the drawer is proximate the cabinet and an extended position where the door of the drawer is spaced apart from the cabinet. The latch is configured to automatically unlock when the drawer slides to the extended position which allows the door to rotate to the open position when the drawer is in the extended position.

18 Claims, 9 Drawing Sheets

REFRIGERATOR APPLIANCE WITH AUTOMATIC OPEN DRAWER FRONT

FIELD

The present disclosure relates generally to refrigerator appliances, and more particularly to refrigerator appliances which include a drawer having a tilt out drawer front feature.

BACKGROUND

Refrigerator appliances generally include a cabinet that defines chilled chambers for receipt of food items for storage. One or more insulated, sealing doors are provided for selectively enclosing the chilled food storage chambers. Consumers generally prefer chilled chambers that facilitate visibility and accessibility of food items stored therein.

In certain refrigerator appliances, commonly referred to as side-by-side style refrigerator appliances, the fresh food chamber is positioned next to the freezer chamber within the cabinet. Such a configuration can permit easy access to food items stored on doors of the refrigerator appliances. However, the cabinet can be deep and narrow such that accessing food items at a back of the fresh food chamber and/or freezer chamber is difficult.

In other refrigerator appliances, the freezer chamber is positioned either above or below the fresh food chamber in the cabinet, which are commonly referred to as top mount or bottom mount refrigerator appliances. Such a configuration can provide a relatively wide fresh food chamber and/or freezer chamber, e.g., as compared to the side-by-side configuration. However, the depth of the fresh food chamber and the freezer chamber can make accessing food items at a back of the refrigerator appliance difficult.

Accordingly, a refrigerator appliance with features for assisting with accessing food items stored therein would be useful.

BRIEF DESCRIPTION

Additional aspects and advantages of the technology will be set forth in part in the following description, or may be apparent from the description, or may be learned through practice of the technology.

In accordance with one embodiment, a refrigerator appliance is provided. The refrigerator appliance includes a cabinet defining a fresh food storage chamber and a frozen food storage chamber and a drawer slidably mounted within one of the fresh food storage chamber and the frozen food storage chamber. The drawer includes a drawer body defining an interior of the drawer and a door attached to the drawer body via a hinge such that the door is rotatable relative to the drawer body between a closed position where the door encloses the interior of the drawer and an open position to provide access to the interior of the drawer. The drawer also includes a latch configured to retain the door in the closed position when the latch is in a locked position. The drawer is slidable between a retracted position where the door of the drawer is proximate the cabinet and an extended position where the door of the drawer is spaced apart from the cabinet. The latch is configured to move from the locked position to an unlocked position and thereby release the door of the drawer when the drawer slides to the extended position. As a result of the latch unlocking, the door is rotatable to the open position when the drawer slides to the extended position.

In accordance with another embodiment, a drawer for a refrigerator appliance is provided. The refrigerator appliance includes a cabinet defining a fresh food storage chamber and a frozen food storage chamber. The drawer is slidably mountable within one of the fresh food storage chamber and the frozen food storage chamber. The drawer includes a drawer body defining an interior of the drawer and a door attached to the drawer body via a hinge such that the door is rotatable relative to the drawer body between a closed position where the door encloses the interior of the drawer and an open position to provide access to the interior of the drawer. The drawer also includes a latch configured to retain the door in the closed position when the latch is in a locked position. The drawer is slidable between a retracted position where the door of the drawer is proximate the cabinet and an extended position where the door of the drawer is spaced apart from the cabinet. The latch is configured to move from the locked position to an unlocked position and thereby release the door of the drawer when the drawer slides to the extended position. As a result of the latch unlocking, the door is rotatable to the open position when the drawer slides to the extended position.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures.

Figure 1:
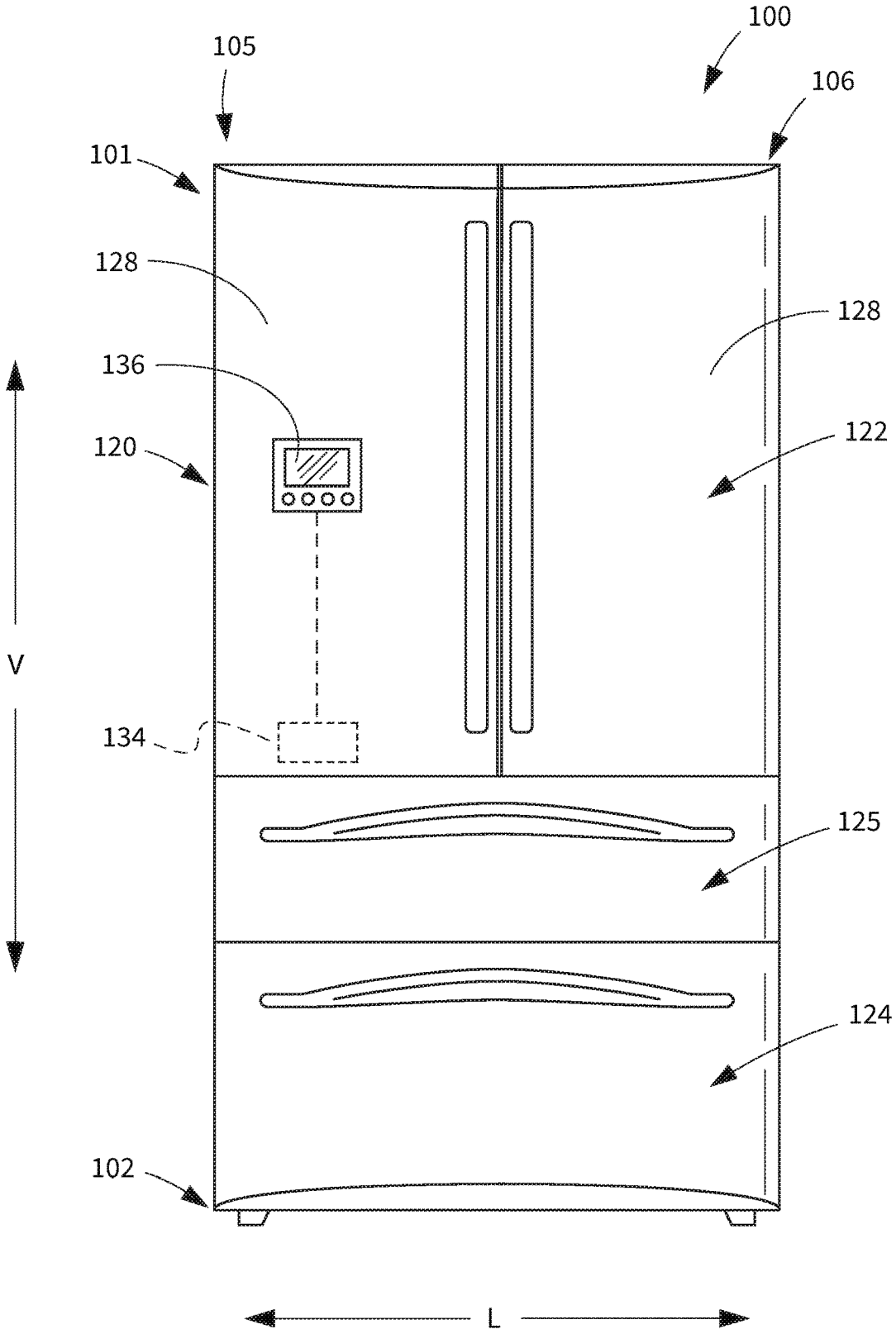
FIG. 1 provides a front view of a refrigerator appliance according to one or more exemplary embodiments of the present subject matter.

Repeat use of reference characters in the present specification and drawings is intended to represent the same or analogous features or elements of the present subject matter.

DETAILED DESCRIPTION

Reference now will be made in detail to embodiments of the technology, one or more examples of which are illustrated in the drawings. Each example is provided by way of explanation of the technology, not limitation of the technology. In fact, it will be apparent to those skilled in the art that various modifications and variations can be made in the present technology without departing from the scope or spirit of the technology. For instance, features illustrated or described as part of one embodiment can be used with another embodiment to yield a still further embodiment. Thus, it is intended that the present technology covers such modifications and variations as come within the scope of the appended claims and their equivalents.

As used herein, the terms "first," "second," and "third" may be used interchangeably to distinguish one component from another and are not intended to signify location or importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," or "bottom" are used with reference to the perspective of a user accessing the refrigerator appliance. For example, a user stands in front of the refrigerator to open the doors and reaches into the food storage chamber(s) to access items therein.

As used herein, terms of approximation such as "generally," "about," or "approximately" include values within ten percent greater or less than the stated value. When used in the context of an angle or direction, such terms include within ten degrees greater or less than the stated angle or direction, e.g., "generally vertical" includes forming an angle of up to ten degrees either clockwise or counterclockwise with the vertical direction V.

Figure 2:
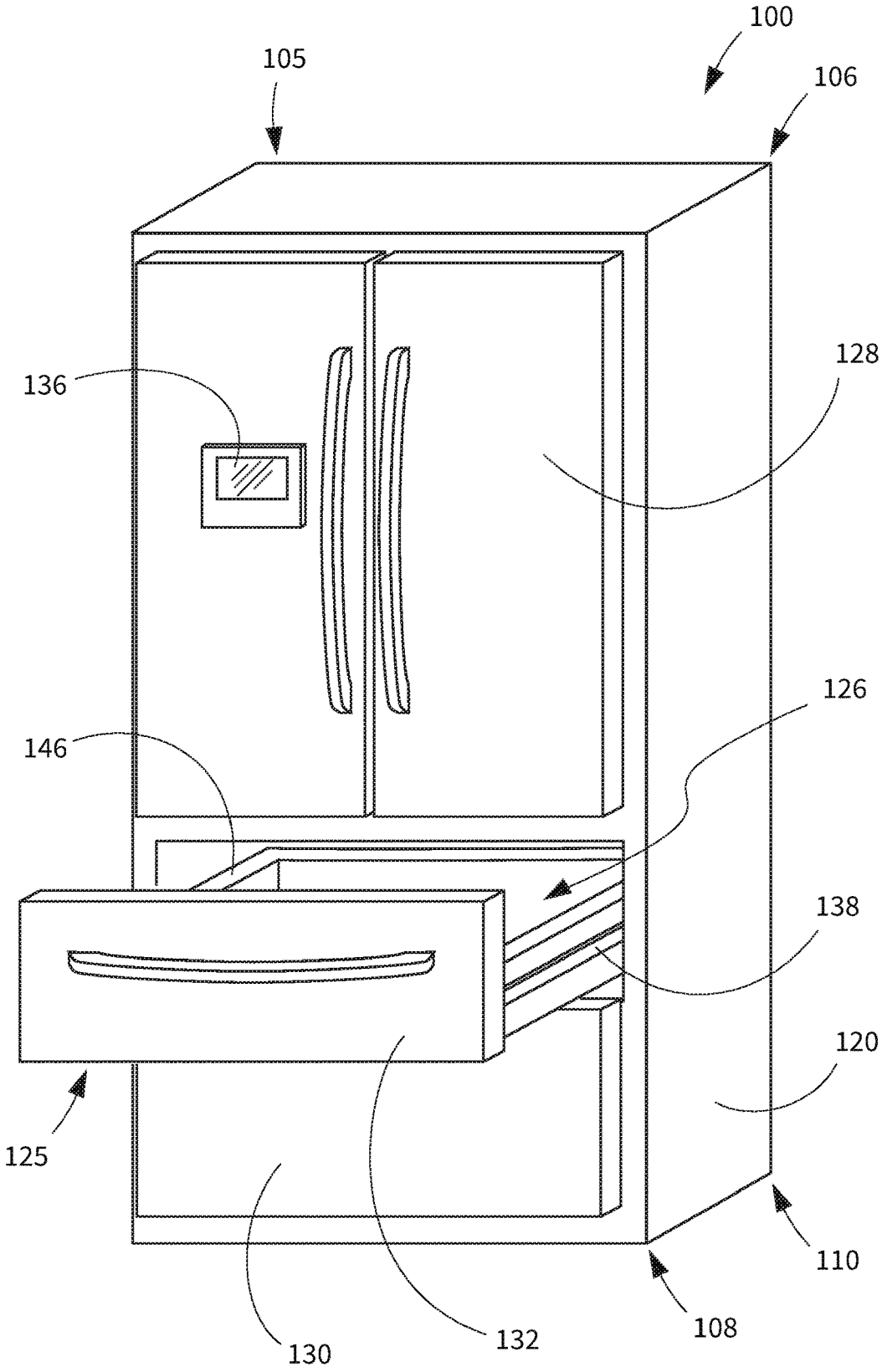
FIG. 2 provides a perspective view of the refrigerator appliance of FIG. 1 with a drawer thereof in an open position and a door of the drawer in a closed position.
Figure 3:
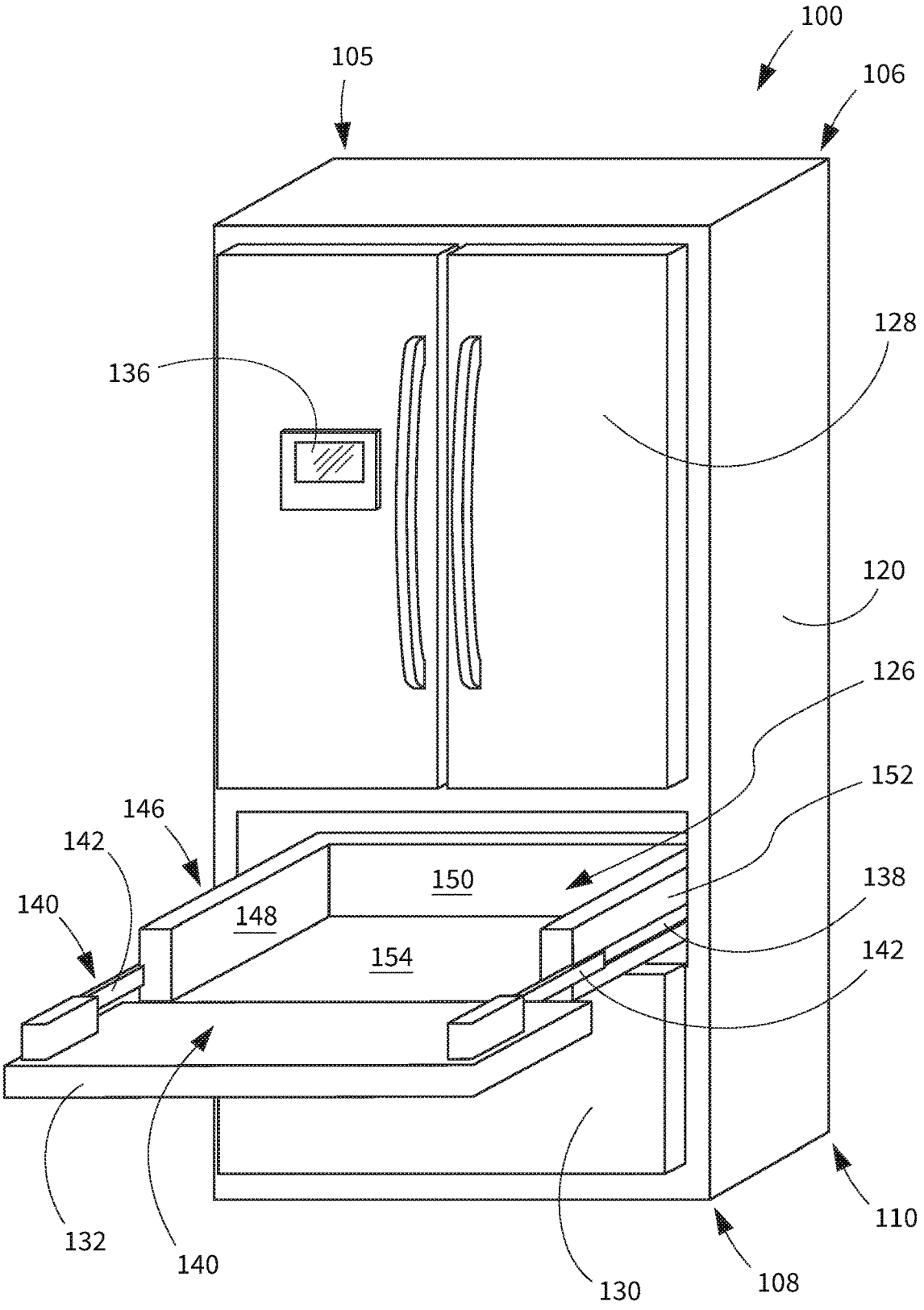
FIG. 3 provides a perspective view of the refrigerator appliance of FIG. 2 with the door of the drawer in an open position.

FIG. 1 is a front view of an exemplary embodiment of a refrigerator appliance 100. FIG. 2 is a perspective view of the refrigerator appliance 100 having a drawer 125 in an open position to reveal the interior 126 of the drawer 125. FIG. 3 is a perspective view of the refrigerator appliance 100 having a door 132 of the drawer 125 in an open position to promote access to the interior 126 of the drawer 125. Refrigerator appliance 100 extends between a top 101 and a bottom 102 along a vertical direction V. Refrigerator appliance 100 also extends between a left side 105 and a right side 106 along a lateral direction L. As shown in FIGS. 2 and 3, a transverse direction T may additionally be defined perpendicular to the vertical and lateral directions V, L. Refrigerator appliance 100 extends along the transverse direction T between a front portion 108 and a back portion 110.

Refrigerator appliance 100 includes a cabinet or housing 120 defining an upper fresh food chamber 122 and a lower freezer chamber or frozen food storage chamber 124 arranged below the fresh food chamber 122 along the vertical direction V. Because the frozen food storage chamber 124 is positioned below the fresh food storage chamber 122, refrigerator appliance 100 is generally referred to as a bottom mount refrigerator. Using the teachings disclosed herein, one of skill in the art will understand that the present technology can be used with other types of refrigerators (e.g., side-by-sides) or a freezer appliance as well. Consequently, the description set forth herein is for illustrative purposes only and is not intended to limit the invention in any aspect.

Refrigerator doors 128 are rotatably hinged to an edge of housing 120 for accessing fresh food chamber 122. It should be noted that while two doors 128 in a "French door" configuration are illustrated, any suitable arrangement of doors utilizing one, two or more doors is within the scope and spirit of the present disclosure. A freezer door 130 is arranged below refrigerator doors 128 for accessing freezer chamber 124. In the exemplary embodiment, freezer door 130 is coupled to a freezer drawer (not shown) slidably coupled within freezer chamber 124.

Operation of the refrigerator appliance 100 can be regulated by a controller 134 that is operatively coupled to a user interface panel 136. Panel 136 provides selections for user manipulation of the operation of refrigerator appliance 100 such as e.g., temperature selections. In response to user manipulation of the user interface panel 136, the controller 134 operates various components of the refrigerator appliance 100. The controller may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller 134 may be positioned in a variety of locations throughout refrigerator appliance 100. In the illustrated embodiment, the controller 134 may be located within one of the doors 128. In such an embodiment, input/output ("I/O") signals may be routed between the controller and various operational components of refrigerator appliance 100. In one embodiment, the user interface panel 136 may represent a general purpose I/O ("GPIO") device or functional block. In one embodiment, the user interface 136 may include input components, such as one or more of a variety of electrical, mechanical or electro-mechanical input devices including rotary dials, push buttons, and touch pads. The user interface 136 may include a display component, such as a digital or analog display device designed to provide operational feedback to a user. The user interface 136 may be in communication with the controller 134 via one or more signal lines or shared communication busses.

FIGS. 2 and 3 illustrate one example embodiment of a drawer 125 for the refrigerator appliance 100. The drawer 125 may be slidably mounted within the cabinet 120, e.g., with slides 138. The drawer 125 may thereby be slidable between a retracted position where the door 132 of the drawer 125 is proximate the cabinet 120, e.g., the door 132 may be sealingly engaged with the cabinet 120 by gaskets 156 (FIG. 4) when in the retracted position, and an extended position where the door 132 of the drawer 125 is spaced apart from the cabinet 120. In other embodiments, the drawer 125 may be an internal drawer without gaskets 156 and the door 132 of the drawer 125 may be proximate the front portion 108 of the cabinet 120 while the door 132 and the remainder of the drawer 125 are fully inside the cabinet 120 in the retracted position. In the illustrated example, the drawer 125 is a freezer drawer slidably mounted within the frozen food storage chamber 124 of the refrigerator appliance 100. Accordingly, the drawer 125 may assist with storing and providing access to frozen food items. For example, smaller food items such as a bag of frozen vegetables may be stored in the freezer drawer 125 to prevent or reduce such items from being obscured under or behind larger items such as a frozen turkey, etc., as compared to when only a single portion of the refrigerator appliance 100 is provided for storing frozen items. In other embodiments, the drawer 125 may be slidably mounted within the fresh food storage chamber 122 and may provide similar advantages with respect to storing and accessing fresh food items.

As will be described in more detail below, the drawer 125 may have a tilt out drawer front, e.g., the door 132 of the drawer 125 may be connected to a drawer body 146 with a hinge 140 such that the door 132 is rotatable relative to the drawer body 146, e.g., between a closed position (FIG. 2) and an open position (FIG. 3).

As best seen in FIG. 3, the drawer 125 may include a drawer body 146 which includes a left wall 148, a back wall 150, a right wall 152, and a floor 154. The drawer body 146 at least partially defines an interior 126 of the drawer 125 which may provide a storage volume, e.g., for food items. For example, in the illustrated embodiments, the interior 126 of the drawer 125 is collectively defined by the drawer body 146 and the door 132. To promote accessibility of such food items which may be stored within the interior 126 of the drawer 125, the door 132 of the drawer 125 may be rotatable relative to the drawer body 146, to an open position as shown in FIG. 3. The door 132 may be rotatable relative to the drawer body 146 in that the door 132 may be connected to the drawer body 146 by one or more hinges 140.

Figure 4:
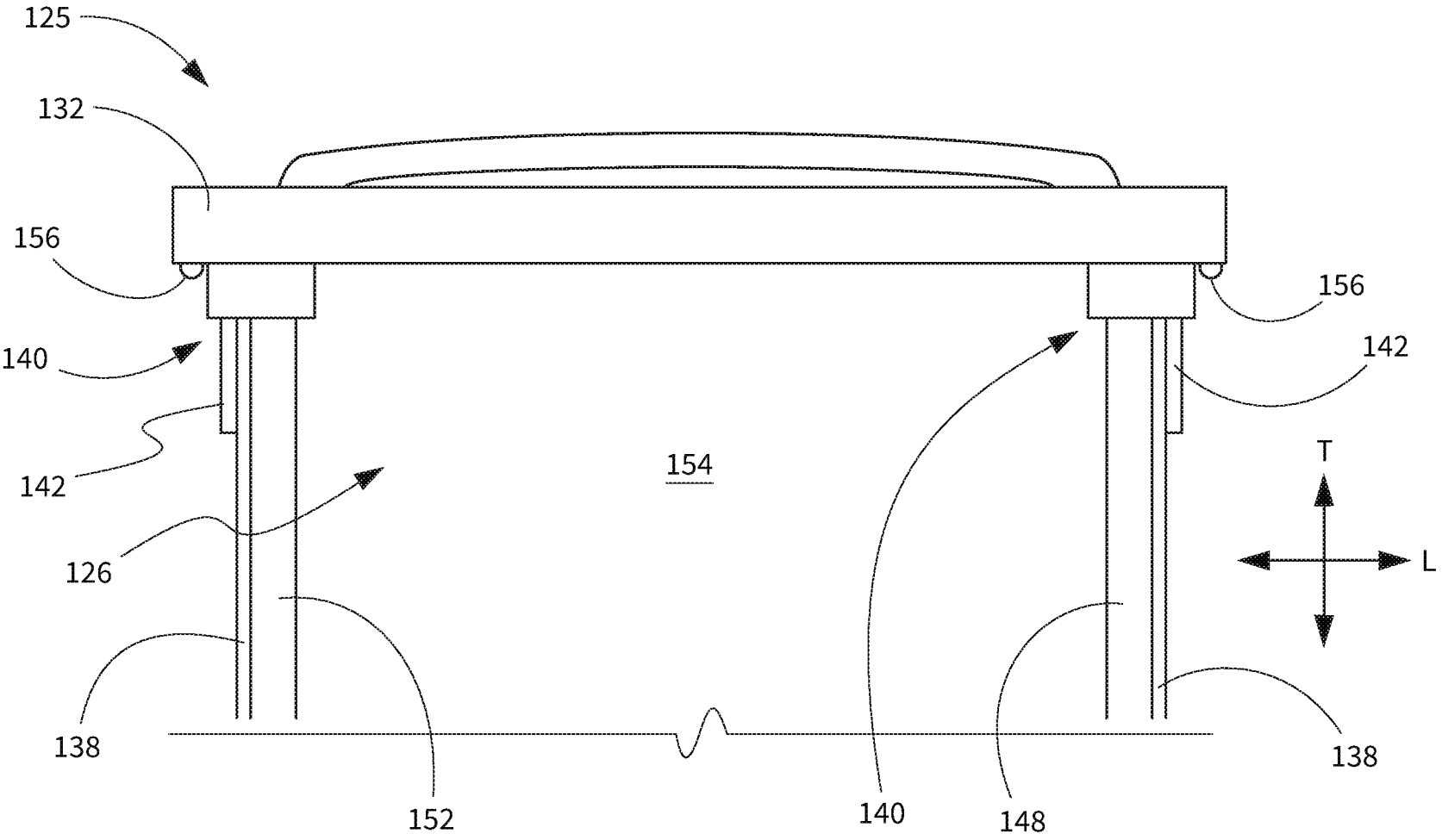
FIG. 4 provides a partial overhead view of the drawer of FIGS. 2 and 3.

For example, as shown in FIG. 4, the door 132 may be connected to the drawer body 146 by a pair of hinges 140, such as a left hinge 140 connected to the left side wall 148 of the drawer body 146 by a pivot arm 142 of the left hinge 140 and a right hinge 140 connected to the right side wall 152 of the drawer body 146 by a pivot arm 142 of the right hinge 140. In some embodiments, the drawer 125 may be slidably mounted within the cabinet 120, e.g., within one of the fresh food storage 122 chamber and the frozen food storage chamber 124, by a left slide 138 on the left side wall 148 and a right slide 138 on the right side wall 152, such that the drawer 125 can slide between the closed position of the drawer 125 (FIG. 1) and the open position of the drawer 125 (FIGS. 2 and 3). Additionally one or more gaskets 156 (FIG. 4) may be provided on the door 132 of the drawer 125 to sealingly engage the cabinet 120 when the drawer 125 is in the closed position. As shown in FIG. 4, the pivot arms 142 of the hinges 140 may each be connected to a corresponding slide 138 at each side wall of the drawer body 146.

Figure 5:
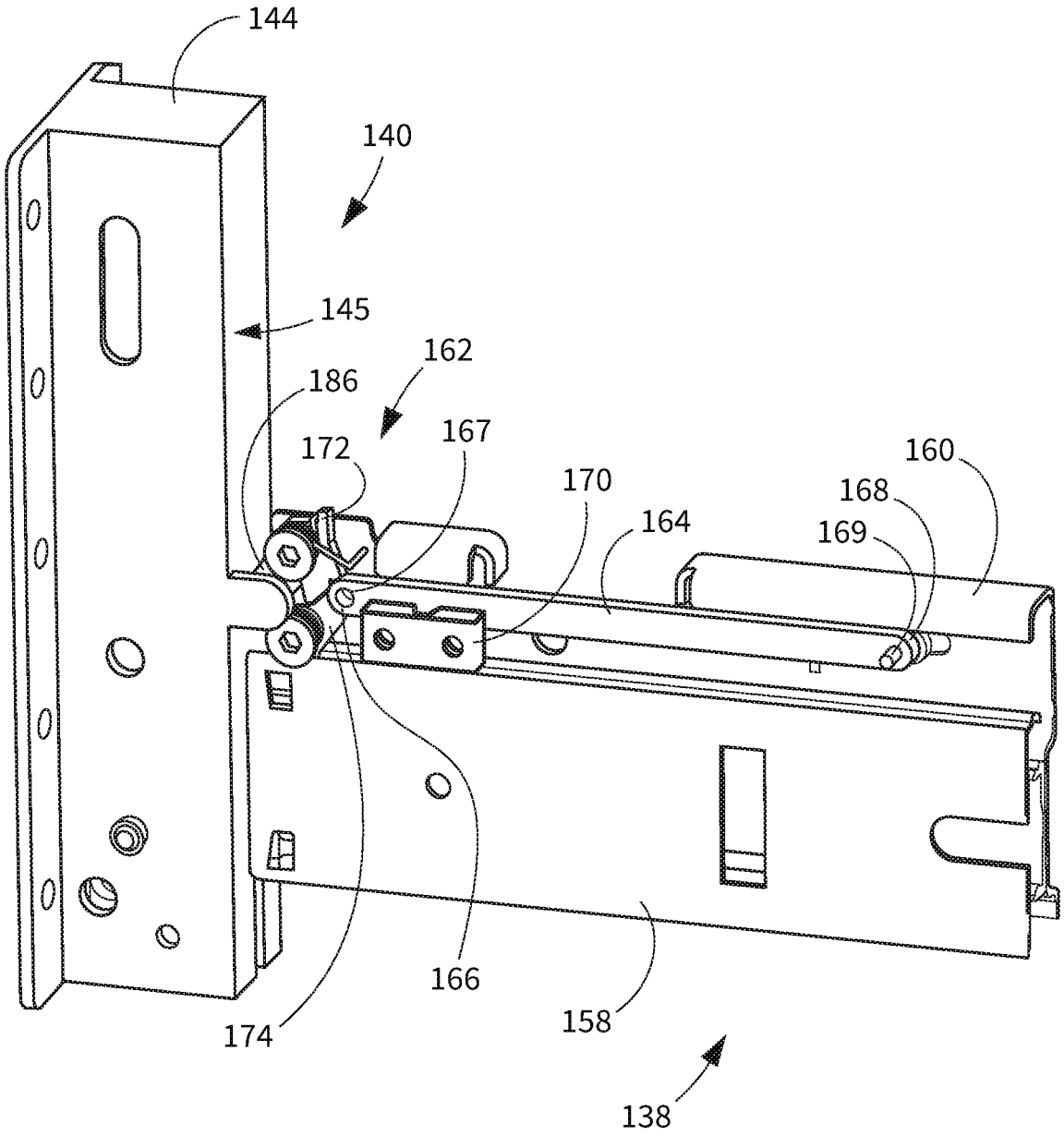
FIG. 5 provides a perspective view of an exemplary right hinge of the drawer and a portion of an exemplary slide with which the drawer is mountable to the cabinet of the refrigerator appliance according to one or more exemplary embodiments of the present subject matter, with an exemplary latch of the drawer in a locked position.

Turning now to FIG. 5, an exemplary hinge 140 of the drawer 125 and a portion of an exemplary slide 138 with which the drawer 125 is mountable to the cabinet 120 of the refrigerator appliance 100 are illustrated. For example, the slide 138 may include a stationary portion 158 which may be fixedly mounted to the cabinet 120, e.g., to an interior wall (not shown) of the cabinet 120 which defines a portion of the fresh food storage chamber 122 or the frozen food storage chamber 124. It should be understood that the stationary portion 158 of the slide 138 may be "fixedly" mounted to the cabinet 120 in that the stationary portion 158 does not move relative to the cabinet 120 during the ordinary and intended operation (e.g., when sliding the drawer 125 in/out of the cabinet 120) of the drawer 125, e.g., without undoing the fixed connection between the stationary portion 158 of the slide 138 and the cabinet 120. For example, the stationary portion 158 of the slide 138 may be fixedly mounted within the cabinet 120 with one or more fasteners such as, but not limited to, rivets, bolts, and/or screws, and the stationary portion 158 of the slide 138 may be also or instead be fixedly mounted within the cabinet 120 by, e.g., welding or soldering. Also as may be seen in FIG. 5, the slide 138 may further include a sliding portion 160 slidably joined to the stationary portion 158. Thus, relative movement, e.g., along the transverse direction T, may be provided between the slide portions 158 and 160. When the stationary portion 158 is fixedly mounted to the cabinet 120 as described herein and the sliding portion 160 is attached to the drawer 125 (e.g., fixedly attached in a similar manner as described hereinabove with respect to the stationary portion 158 and the cabinet 120), the slide provides relative movement, e.g., sliding, of the drawer 125 with respect to the cabinet 120. Thus, the drawer 125 may be slidably mounted within the one of the fresh food storage chamber 122 and the frozen food storage chamber 124 with the slide 138.

Still referring to FIG. 5, an exemplary latch 162 of the drawer 125 is illustrated and, in FIG. 5, the latch 162 is depicted in a locked position. As will be explained in more detail below, the latch 162 is configured to retain the door 125 in the closed position when the latch 162 is in the locked position and is configured to unlock, e.g., to move from the locked position to an unlocked position and thereby release the door 132 of the drawer 125, when the drawer 125 slides to the extended position. As a result of the latch 162 unlocking, the door 132 is rotatable to the open position when the drawer 125 slides to the extended position. Thus, the door 132 provides an automatic open feature, described in more detail below, where the latch 162 automatically unlocks when the drawer 125 is pulled away from the cabinet 120, e.g., to the extended position.

As illustrated for example in FIG. 5, the latch 162 may be connected to a latch release bar 164. For example, the latch release bar 164 may extend from a first end 166 to a second end 168 opposite the first end 166. Thus, the latch release bar 164 may be defined by and between the first end 166 and the second end 168. The latch release bar 164 may be connected to the latch 162 at the first end 166. For example, the latch release bar 164 may include an aperture or through-hole 167 at the first end 166 by which the latch release bar 164 may be connected to the latch 162, e.g., to a pawl 174 of the latch 162. The latch release bar 164 may also include a post or projection 169 at the second end 168. As will be described in more detail below, the projection 169 of the latch release bar 164 may be engaged by a latch release tab 170. As may be seen in FIG. 5, the latch 162 and the latch release bar 164 may be mounted on the sliding portion 160 of the slide 138 and the latch release tab 170 may be mounted on the stationary portion 158 of the slide 138. In other example embodiments, the latch release bar 164 may be mounted on the stationary portion 158 and the latch release tab 170 may be mounted on the sliding portion 160.

Figure 6:
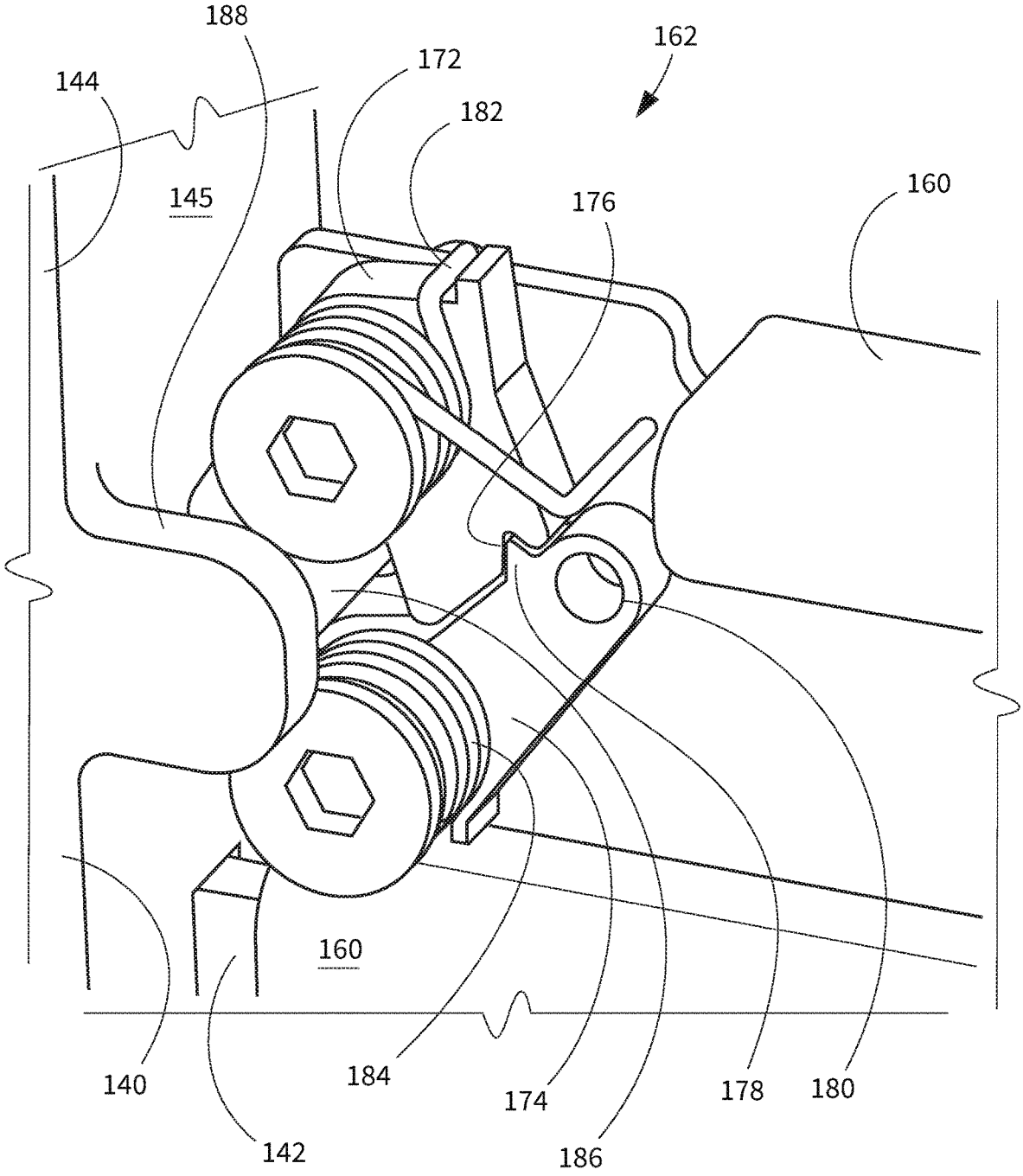
FIG. 6 provides an enlarged view of a portion of FIG. 5, particularly the exemplary latch illustrated therein.

FIG. 6 provides an enlarged view of a portion of FIG. 5, particularly the exemplary latch 162 illustrated therein with the latch release bar 164 removed to better show details of the latch 162. As may be seen in FIG. 6, the latch 162 includes a hook 172 and a pawl 174 which holds the hook 172 in the locked position. For example, as may be seen in FIG. 6, in some embodiments, the hook 172 and the pawl 174 may include a tooth 178 and a detent 176 which interengage to hold the hook 172, and thus the latch 162 itself, in the locked position. The tooth 178 is configured, e.g., sized and shaped, to fit within the detent 176 and thereby provide the aforementioned interengagement. For example, the pawl 174 may include the tooth 178 and the hook 172 may include the detent 176, as illustrated, whereby the tooth 178 of the pawl 174 engages the detent 176 of the hook 172 to hold the hook 172 in the locked position. Also illustrated in FIG. 6, the hinge 140 may include a hinge body 144 with a bar 186 connected to an interior surface 145 (e.g., a surface of the hinge body 144 which faces the interior of the cabinet 120 when the door 132 is in the closed position) of the hinge body 144. As illustrated in FIG. 6, the bar 186 may extend between a pair of projections 188 which project inwardly (e.g., towards the interior of the cabinet 120 when the door 132 is in the closed position) from the interior surface 145 of the hinge body 144. Thus, the hook 172 of the latch 162 may be configured to engage the bar 186 of the hinge body 144 when the latch 162 is in the locked position and the door 132 is in the closed position, whereby the door 132 is retained in the closed position by the engagement of the hook 172 with the bar 186.

As illustrated in the example embodiment of FIG. 6, the pawl may include an aperture or through-hole 180 by which the pawl may be connected to the latch release bar 164. For example, the latch release bar 164 may include the through-hole 167 at the first end 166 of the latch bar 164, and a pin, rivet, threaded fastener or other suitable fastener may be inserted through the respective through-holes 167 and 180 to thereby join the latch release bar 164 and the pawl 174.

As mentioned, the pawl 174 may hold the hook 172 in the locked position. For example, the pawl 174 may hold the hook 172 against the force of a biasing element. In some embodiments, the latch 162 may include a first biasing member 182 connected to the hook 172 and which biases the hook 172 to the unlocked position (the unlocked position being shown, for example, in FIG. 7 which is described in more detail below) such that the pawl 174, when engaged with the hook 172 as described above, may hold the hook 172 in the locked position against the biasing force provided by the first biasing member 182. In some embodiments, for example, the first biasing member 182 may be a coil spring, e.g., as illustrated in FIG. 6. The latch 162 may also include a second biasing member 184 connected to the pawl 174. The second biasing member 174 may be configured to bias the pawl 174 into engagement with the hook 172. Thus, the second biasing member 184 may bias the latch 162 to the locked position.

Figure 7:
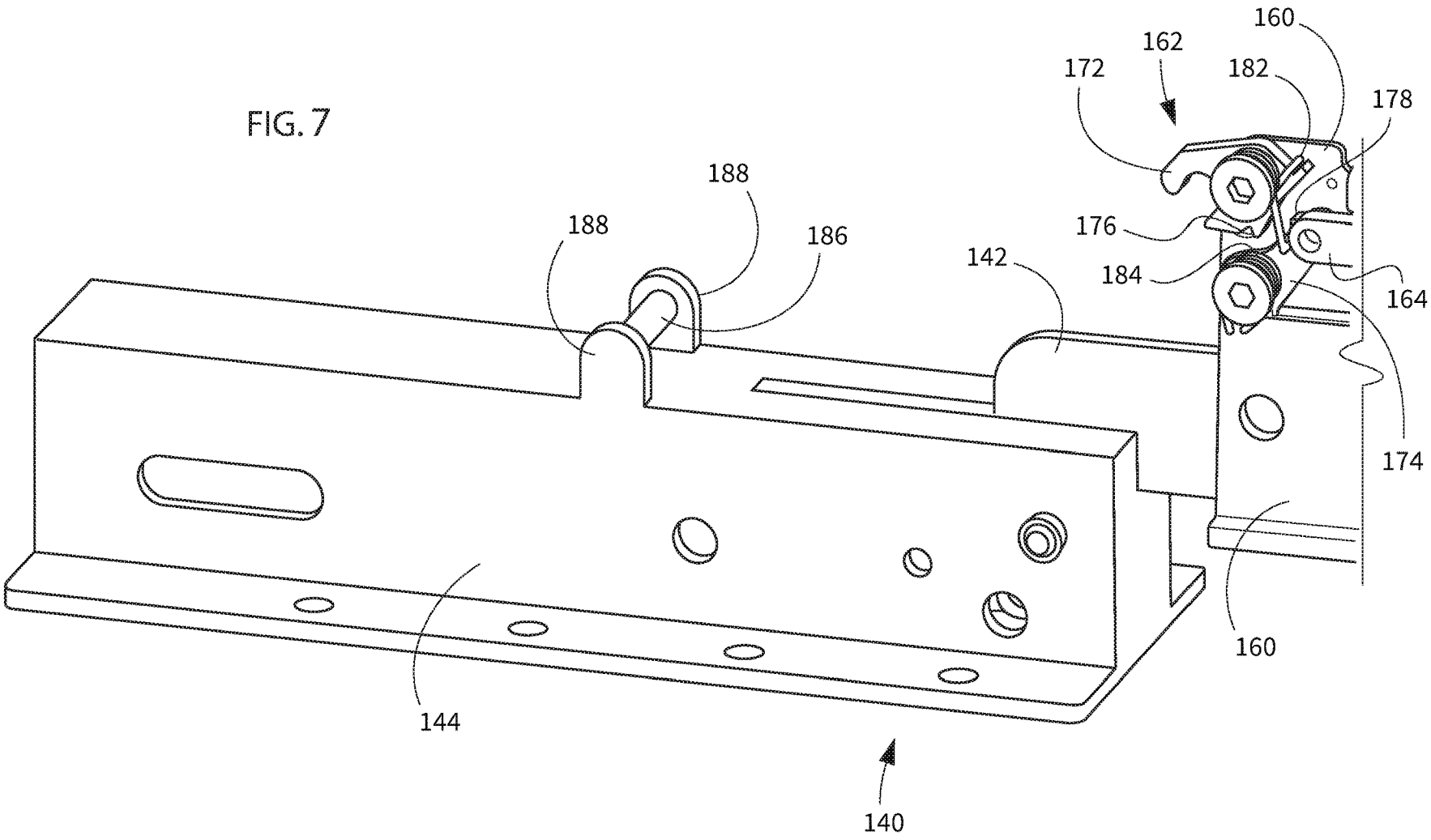
FIG. 7 provides a perspective view of a portion of the assembly illustrated in FIG. 5 with the latch in an unlocked position and the door in an open position.

FIG. 7 provides a perspective view of a portion of the assembly illustrated in FIG. 5 with the latch 162 in an unlocked position and the door 132 in an open position. As mentioned above regarding FIG. 5, the latch 162 and the latch release bar 164 may be mounted on the sliding portion 160 of the slide 138 and the latch release tab 170 may be mounted on the stationary portion 158 of the slide 138. Thus, when the drawer 125 slides to the extended position, the sliding portion 160, along the with latch 162 and latch release bar 164 mounted thereon, may slide outward (e.g., away from the cabinet 120, such as to the left as illustrated in FIG. 5) relative to the stationary portion 158 and the latch release tab 170 mounted on the stationary portion 158. When the drawer 132 is at or near the extended position, the latch release tab 170 may engage the second end 168 of the latch release bar 164, e.g., the projection 169 of the latch release bar 164 may contact the latch release tab 170, arresting the outward motion of the latch release bar 164, whereupon the latch release bar 164 (which is connected to the pawl 174 at the first end 166 of the latch release bar 164, as described above) may pull the pawl 174 away from the hook 172 and against the biasing force of the second biasing member 184 until the latch release bar 164 pulls the pawl 174 out of engagement with the hook 172 and, as a result, the latch 162 moves to the unlocked position. When the pawl 174 is pulled away from the hook 172 by the latch release bar 164, the first biasing member 182 then urges or biases the hook 172 to the unlocked position, thereby unlocking the latch 162. In some example embodiments, the latch release bar 164 may pull the pawl 174 away from the hook 172 to unlock the latch 162 when the drawer 125 slides to the extended position, such as a fully extended position defined by the maximum range of movement of the slide 138. Thus, the latch 162 may be automatically unlocked by the latch release tab 170 acting on the latch release bar 164, which in turn acts on the pawl 174 to unlock the latch at a defined point along the range of sliding motion between the retracted position of the drawer 125 and the extended position of the drawer 125. For example, such point may be defined by the relative size and position (e.g., along the transverse direction T) of the latch release tab 170 and the latch release bar 164, in particular the projection 169 of the latch release bar 164.

Figure 8:
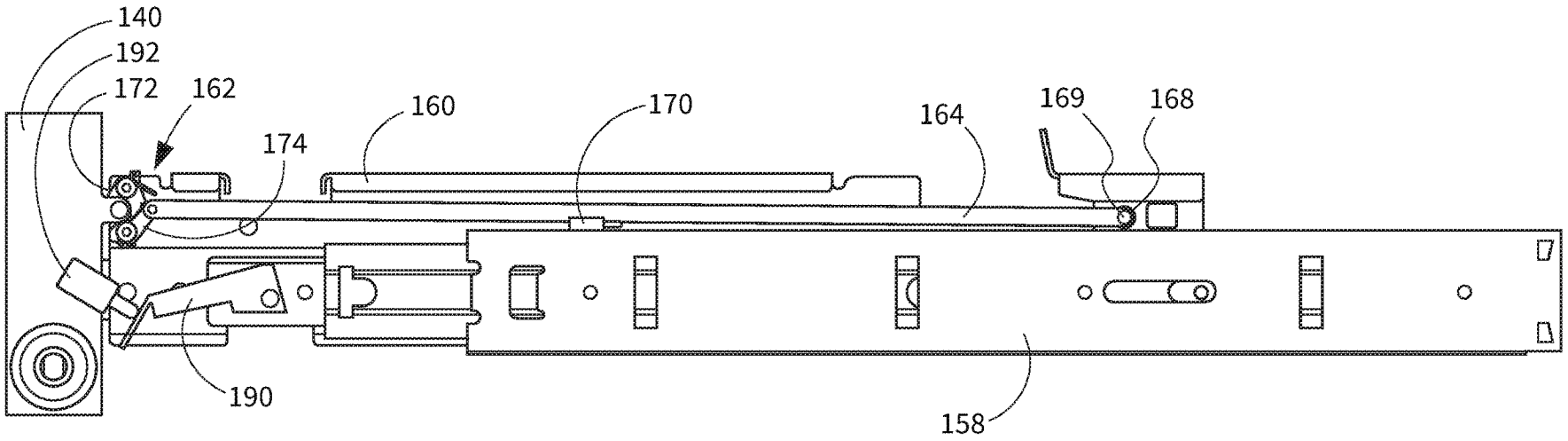
FIG. 8 provides a side view of an exemplary right hinge of the drawer and an exemplary slide with which the drawer is mountable to the cabinet of the refrigerator appliance according to one or more exemplary embodiments of the present subject matter, with a latch of the drawer in a locked position and a lock of the slide in an unlocked position.
Figure 9:
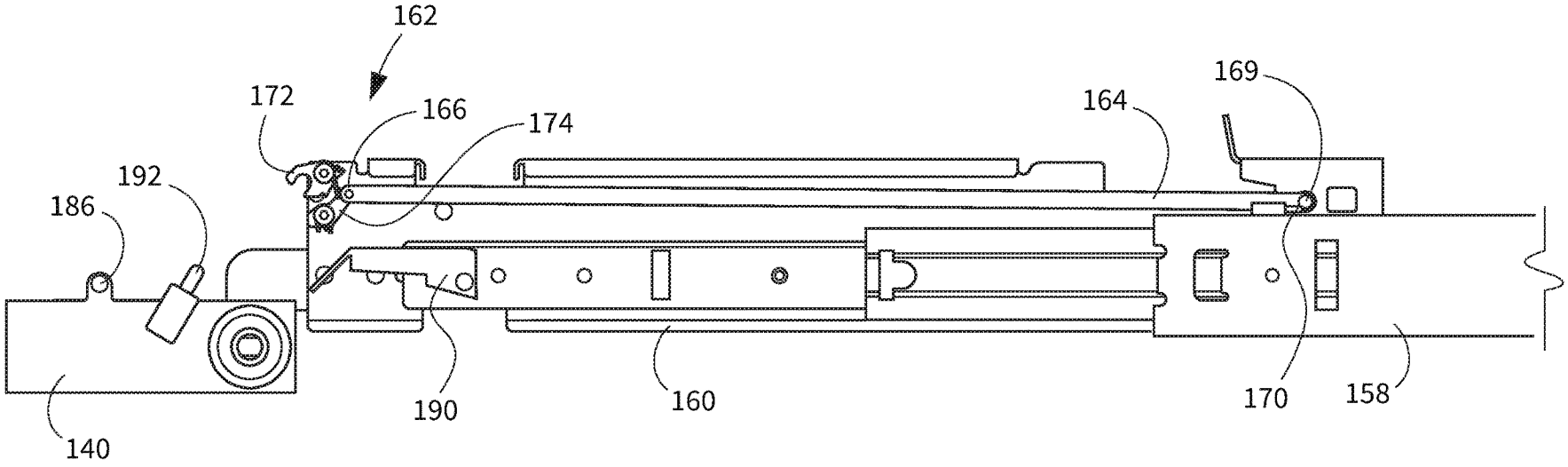
FIG. 9 provides a side view of the hinge and slide of FIG. 8 with the latch of the drawer in an unlocked position and the lock of the slide in a locked position.

FIG. 8 provides a side view of an exemplary right hinge 140 of the drawer 125 and an exemplary slide 138 with which the drawer 125 is mountable to the cabinet 120 of the refrigerator appliance 100 according to one or more exemplary embodiments of the present subject matter. As shown in FIG. 8, the latch 162 of the drawer 125 is in a locked position. As may be seen in FIG. 8, the drawer 125 may also include a lock 190 configured to lock the slide 138 and thereby prevent or inhibit sliding movement of the drawer 125, e.g., by locking the sliding portion 160 and the stationary portion 158 of the slide 138 together so as to prevent or limit relative motion therebetween. The lock 190 of the slide 138 is depicted in FIG. 8 in an unlocked position. FIG. 9 provides a side view of the drawer 125 with the latch 162 in the unlocked position, the hinge 140 in the open position, and the lock 192 of the slide 138 in a locked position where the lock 190 prevents or inhibits relative motion between the sliding portion 160 and the stationary portion 158 of the slide 138. As may be seen in FIGS. 8 and 9, the lock 190 of the slide 138 is held in the unlocked position when the door 132 (e.g., the hinge 140 thereon) is in the closed position and the lock 190 locks, e.g., moves to the locked position, when the door 132 opens, in order to prevent sliding of the drawer 125 when the door 132 is in the open position. In particular, the door 132 (e.g., the hinge 140 thereon) may include a finger 192 configured to contact the lock 190 and release the lock 190 when the door 132 moves from the open position to the closed position. Thus, with the door 132 in the closed position, the drawer 125 may slide between the retracted position and the extended position. Further, the slide 138 may automatically lock when the door 132 of the drawer 125 is opened, e.g., when the finger 192 moves away from the lock 190 as the door 132 moves from the closed position to the open position, the lock 190 of the slide 138 will move the locked position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a fresh food storage chamber and a frozen food storage chamber;

a drawer slidably mounted within one of the fresh food storage chamber and the frozen food storage chamber, the drawer comprising:

a drawer body defining an interior of the drawer;

a door attached to the drawer body via a hinge whereby the door is rotatable relative to the drawer body between a closed position where the door encloses the interior of the drawer and an open position to provide access to the interior of the drawer; and a latch configured to retain the door in the closed position when the latch is in a locked position; wherein the latch comprises a hook, the hinge comprises a hinge body with a bar connected to an interior surface of the hinge body, and the hook of the latch is configured to engage the bar of the hinge body when the latch is in the locked position and the door is in the closed position, whereby the door is retained in the closed position by the engagement of the hook with the bar;

wherein the drawer is slidable between a retracted position where the door of the drawer is proximate the cabinet and an extended position where the door of the drawer is spaced apart from the cabinet, and wherein the latch is configured to move from the locked position to an unlocked position and thereby release the door of the drawer when the drawer slides to the extended position, whereby the door is rotatable to the open position when the drawer slides to the extended position.

2. The refrigerator appliance of claim 1, wherein the latch further comprises a biasing member connected to the hook and the biasing member biases the hook to the unlocked position.

3. The refrigerator appliance of claim 2, wherein the latch further comprises a pawl configured to engage the hook, wherein the pawl engages the hook to retain the hook in the locked position when the latch is in the locked position.

4. The refrigerator appliance of claim 3, wherein the biasing member connected to the hook is a first biasing member, the latch further comprises a second biasing member connected to the pawl, and wherein the second biasing member is configured to bias the pawl into engagement with the hook whereby the second biasing member biases the latch to the locked position.

5. The refrigerator appliance of claim 3, further comprising a latch release bar connected to the pawl, wherein the latch release bar pulls the pawl out of engagement with the hook when the drawer slides to the extended position, whereby the pawl releases the hook and the latch moves to the unlocked position when the drawer slides to the extended position.

6. The refrigerator appliance of claim 5, wherein the latch release bar is connected to the pawl at a first end of the latch release bar, further comprising a latch release tab which engages a second end of the latch release bar when the drawer slides to the extended position.

7. The refrigerator appliance of claim 6, wherein the drawer is slidably mounted within the one of the fresh food storage chamber and the frozen food storage chamber with a slide, the slide comprising a stationary portion fixedly mounted to the cabinet and a sliding portion slidably joined to the stationary portion, wherein the latch release bar is mounted on the sliding portion of the slide and the latch release tab is mounted on the stationary portion of the slide.

8. A refrigerator appliance, comprising:

a cabinet defining a fresh food storage chamber and a frozen food storage chamber;

a drawer slidably mounted within one of the fresh food storage chamber and the frozen food storage chamber, the drawer comprising:

a drawer body defining an interior of the drawer;

a door attached to the drawer body via a hinge whereby the door is rotatable relative to the drawer body between a closed position where the door encloses the interior of the drawer and an open position to provide access to the interior of the drawer; and a latch configured to retain the door in the closed position when the latch is in a locked position;

wherein the drawer is slidable between a retracted position where the door of the drawer is proximate the cabinet and an extended position where the door of the drawer is spaced apart from the cabinet, and wherein the latch is configured to move from the locked position to an unlocked position and thereby release the door of the drawer when the drawer slides to the extended position, whereby the door is rotatable to the open position when the drawer slides to the extended position; wherein the drawer is slidably mounted within the one of the fresh food storage chamber and the frozen food storage chamber with a slide, the slide comprising a lock configured to lock the drawer in the extended position, the door comprising a finger configured to contact the lock and release the lock when the door moves from the open position to the closed position.

9. The refrigerator appliance of claim 8, wherein the drawer body comprises a left side wall and a right side wall and the drawer is slidably mounted within the one of the fresh food storage chamber and the frozen food storage chamber by a left slide on the left side wall and a right slide on the right side wall, wherein the hinge is one of a pair of hinges comprising a left hinge connected to the left side wall of the drawer body by a pivot arm of the left hinge and a right hinge connected to the right side wall of the drawer body by a pivot arm of the right hinge, and wherein the latch is one of a pair of latches, each said latch of the pair of latches corresponding to one of the left hinge and the right hinge.

10. A drawer for a refrigerator appliance, the refrigerator appliance comprising a cabinet defining a fresh food storage chamber and a frozen food storage chamber, the drawer configured for slidably mounting within one of the fresh food storage chamber and the frozen food storage chamber, the drawer comprising:

a drawer body defining an interior of the drawer;

a door attached to the drawer body via a hinge whereby the door is rotatable relative to the drawer body between a closed position where the door encloses the interior of the drawer and an open position to provide access to the interior of the drawer; and a latch configured to retain the door in the closed position when the latch is in a locked position; wherein the latch comprises a hook, the hinge comprises a hinge body with a bar connected to an interior surface of the hinge body, and the hook of the latch is configured to engage the bar of the hinge body when the latch is in the locked position and the door is in the closed position, whereby the door is retained in the closed position by the engagement of the hook with the bar;

wherein the drawer is slidable between a retracted position and an extended position, and wherein the latch is configured to move from the locked position to an unlocked position and thereby release the door of the drawer when the drawer slides to the extended position, whereby the door is rotatable to the open position when the drawer slides to the extended position.

11. The drawer for a refrigerator appliance of claim 10, wherein the latch further comprises a biasing member connected to the hook and the biasing member biases the hook to the unlocked position.

12. The drawer for a refrigerator appliance of claim 11, wherein the latch further comprises a pawl configured to engage the hook, wherein the pawl engages the hook to retain the hook in the locked position when the latch is in the locked position.

13. The drawer for a refrigerator appliance of claim 12, wherein the biasing member connected to the hook is a first biasing member, the latch further comprises a second biasing member connected to the pawl, and wherein the second biasing member is configured to bias the pawl into engagement with the hook whereby the second biasing member biases the latch to the locked position.

14. The drawer for a refrigerator appliance of claim 12, further comprising a latch release bar connected to the pawl, wherein the latch release bar pulls the pawl out of engagement with the hook when the drawer slides to the extended position, whereby the pawl releases the hook and the latch moves to the unlocked position when the drawer slides to the extended position.

15. The drawer for a refrigerator appliance of claim 14, wherein the latch release bar is connected to the pawl at a first end of the latch release bar, further comprising a latch release tab which engages a second end of the latch release bar when the drawer slides to the extended position.

16. The drawer for a refrigerator appliance of claim 15, wherein the drawer is slidably mounted with a slide, the slide comprising a stationary portion fixedly mounted to the cabinet and a sliding portion slidably joined to the stationary portion, wherein the latch release bar is mounted on the sliding portion of the slide and the latch release tab is mounted on the stationary portion of the slide.

17. The drawer for a refrigerator appliance of claim 10, wherein the drawer is slidably mounted with a slide, the slide comprising a lock configured to lock the drawer in the extended position, the door comprising a finger configured to contact the lock and release the lock when the door moves from the open position to the closed position.

18. The drawer for a refrigerator appliance of claim 10, wherein the drawer body comprises a left side wall and a right side wall and the drawer is slidably mounted by a left slide on the left side wall and a right slide on the right side wall, wherein the hinge is one of a pair of hinges comprising a left hinge connected to the left side wall of the drawer body by a pivot arm of the left hinge and a right hinge connected to the right side wall of the drawer body by a pivot arm of the right hinge, and wherein the latch is one of a pair of latches, each said latch of the pair of latches corresponding to one of the left hinge and the right hinge.

* * * * *